United States Patent [19]

Kiyoto et al.

[11] Patent Number: 4,534,196

[45] Date of Patent: Aug. 13, 1985

[54] METHOD FOR MANUFACTURING A MOLD

[75] Inventors: Shinichiro Kiyoto; Chikara Fujiwara, both of Nagoya, Japan

[73] Assignee: Mitsubishi Jukogyo Kabushiki Kaisha, Tokyo, Japan

[21] Appl. No.: 521,315

[22] Filed: Aug. 5, 1983

[30] Foreign Application Priority Data

Oct. 7, 1982 [JP] Japan ..... 57-175319

[51] Int. Cl.[3] ..... B21D 22/10

[52] U.S. Cl. ..... 72/61; 72/342; 72/364

[58] Field of Search ..... 72/60, 342, 61, 364

[56] References Cited

U.S. PATENT DOCUMENTS 3,943,441 1/1976 Hamilton et al. ..... 72/342

3,974,673 8/1976 Fosness et al. ..... 72/342

*Primary Examiner*—Leon Gilden

*Attorney, Agent, or Firm*—Wenderoth, Lind & Ponack

[57] ABSTRACT

A method for manufacturing a mold to be used when the powder a titanium alloy is filled in the mold and the powder is hot pressed under static water pressure; the improvement is that the mold is manufactured by subjecting a titanium alloy plate having the same composition as the aforementioned titanium alloy powder to super-plastic shaping.

2 Claims, 8 Drawing Figures

METHOD FOR MANUFACTURING A MOLD

The present invention relates to a method for manufacturing a mold to be used in a process for obtaining a titanium alloy member by filling a powder of a titanium alloy in a mold and hot-pressing the powder under static water pressure, and more particularly to a method for providing the aforementioned mold will eliminate any troubles caused between the mold and the product obtained within the mold.

The use of titaniun alloys is at present, abruptly increasing as members for employment for parts in an airplane or the like. However, for such titanium alloys the draft upon forging must be large in view of the properties of this particular material, consequently the weight of the raw material would amount, on an average to 7 times and in some cases to even 20 times as large as the weight of the manufactured part. Moreover, the raw material cost and the cutting and grinding cost, included in the part manufacturing cost, is extremely high. Accordingly, to obtain a titanium raw material close to a final shape of a part, that is, having the so-called "near net shape" is extremely important in view of the cost as well as from the view point of energy saving.

A process which has been marked at present as this near net shape fabricating process of titanium alloys is a static water pressure hot-pressing process. This static water pressure hot-pressing process is such a process that the mold simulated to the shape of a part is manufactured by means of glass, ceramics, steel, etc., then a titanium alloy powder is filled within this mold, and subsequently a static water pressure hot-pressing treatment is effected under high-temperature high-pressure conditions of about 1000° C. and at 1000 atms, and thereafter a titanium raw material having a near net shape is obtained by removing the mold.

In order to fabricate a titanium member having a near net shape through the static water pressure hot-pressing process, the manufacture of a pressing force transmitting mold manufactured on a larger scale as simulated to the shape of the part is especially important, and these molds include a metallic mold, a glass mold, a ceramic mold and the like.

A metallic mold is a metal can (the material being soft steel or the like) formed by press-shaping, welding, etc. so as to have an inner space of a similarly enlarged shape to the shape of the part, and after the titanium alloy powder has been filled in this mold the powder is subjected to static water pressure hot-pressing. For a glass mold, glass having such composition that the temperature used upon static water pressure hot-pressing may be between the softening point and the strain point of the glass employed, and this glass material is shaped into a desired configuration as by a slip-cast process. A ceramic mold is manufactured by making use of a lost-wax process, and a titanium alloy powder is filled within this mold and is subjected to static water pressure hot-pressing by the intermediary of a secondary pressure medium.

However, in these prior art processes, since materials different from the titanium alloy are used as the mold material, the prior art processes involve many problems such as reactions between the mold material and the titanium material upon static water pressure hot-pressing, contraction deformation of the mold resulting from compacting the powder caused by the static water pressure hot-pressing, the necessity of removing the mold after termination of the static water pressure hot-pressing, and the like.

It is therefore one object of the present invention to provide a novel method for manufacturing a mold to be used when an titanium alloy powder is filled in the mold and subjected to static water pressure hot-pressing, which method is free from the disadvantages of the known methods in the prior art.

According to one feature of the present invention, there is provided a method for manufacturing a mold to be used when a titanium alloy powder is filled in the mold and the powder is hot pressed under static water pressure, in which a titanium alloy plate having the same composition as the titanium alloy powder is subjected to super-plastic shaping.

The above-mentioned and other features and objects of the present invention will become more apparent by reference to the following description of preferred embodiments of the invention taken in conjunction with the accompanying drawings, wherein.

A sequence of procedures in one preferred embodiment of the process for manufacturing a mold according to the present invention are illustrated in FIGS. 1 through 4.

Preferred Embodiment 1

Figure 1:
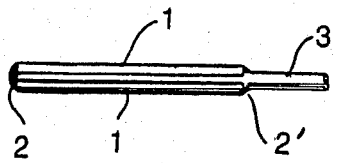
FIGS. 1 through 4 are schematic views showing successive steps of procedures in one preferred embodiment of a method for manufacturing a mold according to the present invention.
Figure 2:
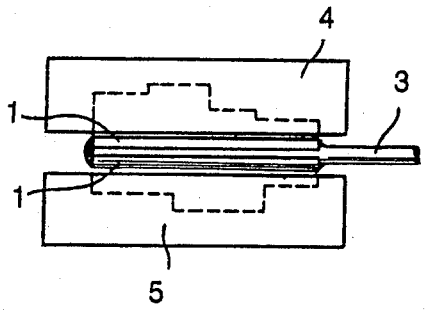
Figure 3:
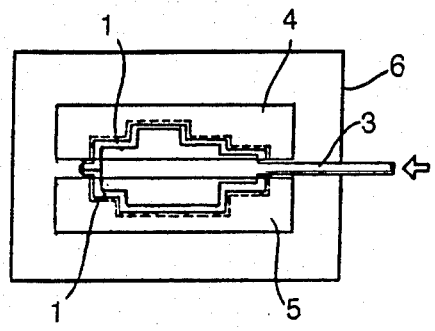
Figure 4:
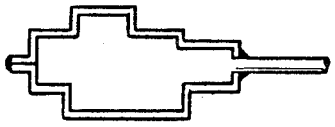

A first, as shown in FIG. 1, two sheets of titanium alloy plates 1 having the same composition as the titanium alloy powder to be subjected to static water pressure hot-pressing are overlapped, their peripheral edges are sealingly closed by welding as shown at 2, a gas supplying pipe 3 is coupled by welding to a part of the peripheral edge as shown at 2', then this assembly is positioned between an upper die 4 and a lower die 5 respectively have their inside bored in a desired mold shape as shown by the dash-lines in FIG. 2, subsequently as shown in FIG. 3 the titanium alloy plates 1 are heated up to a shaping temperature (for instance, up to about 900° C. in the case of a Ti-6Al-4V alloy), and also a pressure is applied to the space between the two titanium alloy plates 1 by means of an inert gas supplied through the pipe 3 (for instance, up to about 10 kg/cm$^2$ in the case of the above-referred Ti-6Al-4V alloy). In this way, a mold for the static water pressure hot-pressing of a titanium alloy powder is prepared through super-plastic shaping. FIG. 4 shows a mold manufactured through the above-mentioned process.

If static water pressure hot-pressing of a titanium alloy powder is carried out by making use of this mold, then as the mold becomes integral with the titanium alloy powder and forms a portion of a product member, removal of a mold becomes unnecessary, and the aforementioned problems in the prior art such as reaction between the mold and titanium alloy powder and the contraction deformation of the titanium alloy powder upon static water pressure hot-pressing, would be entirely eliminated.

Furthermore, although a titanium alloy plate is normally hardly shaped, owing to the employment of the super-plastic shaping process, a mold having a complex configuration and being closer to a near net shape can be easily shaped.

In this way, if the mold manufactured through the method according to the present invention is used, then the highly practicable static water pressure hot-pressing process of titanium alloy powder can be realized.

Preferred Embodiment 2

Figure 5:
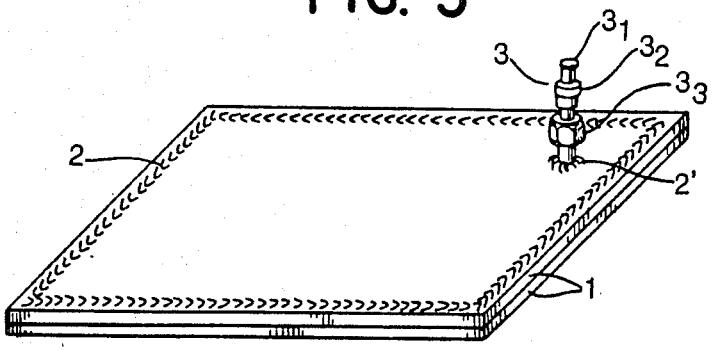
FIGS. 5 through 7 are schematic views showing the essential means of a manufacturing the mold according to another preferred embodiment of the present invention.

As shown in FIG. 5, two sheets of Ti-6Al-4V alloy plates 1 each having dimensions of 180 mm×300 mm×1.27 mm (in thickness) are overlapped, and their peripheral edges are sealingly closed by seam welding 2. Thereupon, as the upper plate 1, a plate which has a gas filling pipe 3 preliminarily welded by fillet welding 2' is used. It is to be noted that the pipe 3 is made of Ti-3Al-2.5V alloy, its tip end being machined to be flared as shown at $3_1$, and the pipe 3 is provided with a sleeve $3_2$ made of stainless steel and a nut $3_3$.

Figure 6:
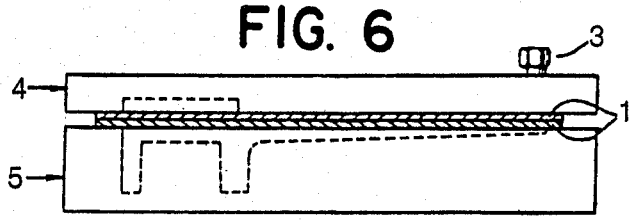
Figure 7:
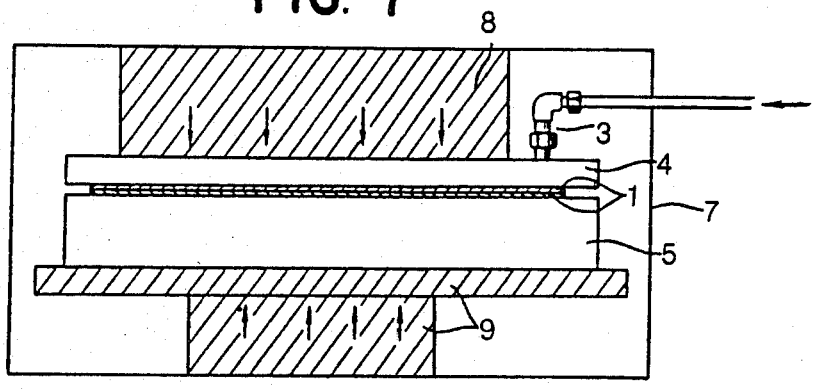

The titanium alloy plate assembly constructed in the above-described manner is positioned between an upper die 4 and a lower die 5 which have their insides bored in a desired mold shape as shown by dash-lines in FIG. 6, then the entire assembly is heated in a furnace 7 as shown in FIG. 7, after the temperature has reached 800° C., an inert gas (Ar) is introduced between the above-described two titanium alloy plates 1 through the gas filling pipe 3 to apply a gas pressure to the inner space, thereafter as the temperature is raised the gas pressure also rises, thus super-plastic shaping is caused, and thereby a mold for static water pressure hot-pressing of titanium powder is manufactured. It is to be noted that during the above-mentioned operation, pressing pressures are applied to the upper and lower dies 4 and 5, respectively, by press means 8 and 9.

Figure 8:
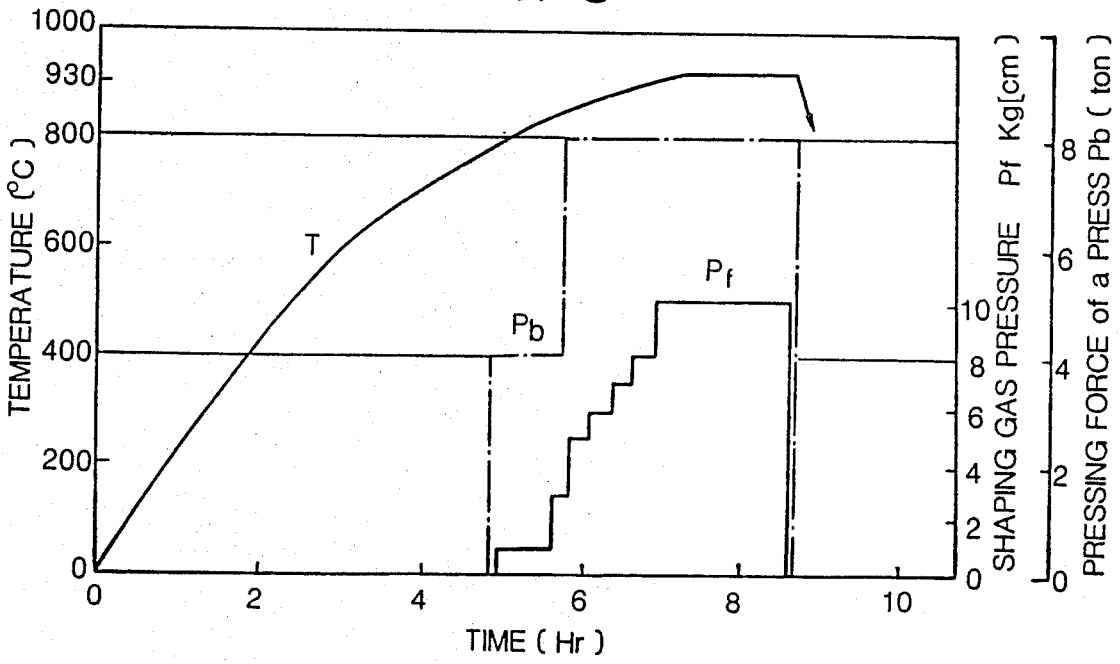
FIG. 8 is a diagram showing the relationship of the temperature T, the pressing force of a press $P_b$ and the shaping gas pressure $P_f$ versus time in terms of hours in the illustrated embodiments.

In addition, in FIG. 8 are illustrated relations between time and super-plastic conditions (temperature T and gas pressure $P_f$) and between time and pressing forces of a press by making use of the press means 8 and 9.

While the present invention has been described above in connection to preferred embodiments of the invention, it is intended that as a matter of course, the present invention should not be limited to the illustrated embodiments, but many changes and modifications could be made without departing from the spirit of the present invention.

What is claimed is:

1. A method for manufacturing hollow mold to be used when titanium alloy powder is filled in the mold and the powder is hot pressed under static water pressure, characterized in that two sheets of titanium plates are overlapped, their edges are welded together to seal the plates together with a gas supplying pipe being welded to one part of the peripheral edges of said plate assembly, the plate assembly is placed between two molds of the desired configuration and pressure applied, heat is applied to the titanium plate assembly to the shaping temperature and gas supplied through the pipe to exert pressure between the plates, thus casing the titanium plates to expand in conformity to the shape of the mold by super-plastic shaping to form a titanium alloy mold.

2. A method according to claim 1 wherein the gas supplied between the sealed titanium plates is an inert gas.

* * * * *